United States Patent [19]

Jablonski

[11] 4,159,356

[45] Jun. 26, 1979

[54] IMPREGNATING FOAM WITH LIQUID FABRIC CONDITIONER

[75] Inventor: Richard J. Jablonski, Marlton, N.J.

[73] Assignee: Scott Paper Company, Philadelphia, Pa.

[21] Appl. No.: 785,547

[22] Filed: Apr. 7, 1977

[51] Int. Cl.[2] ..... B05D 1/28; B05D 3/12

[52] U.S. Cl. ..... 427/244; 118/249; 118/250; 427/361; 427/365; 427/369; 427/374 D

[58] Field of Search ..... 427/244, 365, 366, 361, 427/369, 374 D, 211; 118/249, 250

[56] References Cited

U.S. PATENT DOCUMENTS

| | | | |
|---|---|---|---|
| 47,427 | 4/1865 | Kelley | 118/249 X |
| 3,360,415 | 12/1967 | Hellman et al. | 427/365 X |
| 3,686,025 | 8/1972 | Morton | 427/242 X |
| 3,870,145 | 3/1975 | Mozuno | 427/242 X |
| 3,894,165 | 5/1973 | Bates | 427/244 |

*Primary Examiner*—Evan K. Lawrence
*Attorney, Agent, or Firm*—Nicholas J. De Benedictis; John W. Kane, Jr.

[57] ABSTRACT

Heat activated, fabric conditioning products are made by impregnating a thick, absorbent substrate with fabric-conditioner chemicals. Such products are designed for use at elevated temperatures encountered in laundry dryers. This invention provides a process for impregnating the substrate with liquid fabric conditioning chemicals. By limiting the volume of impregnate in contact with the substrate during compression of the substrate in a nip, precise control is obtained over both the quantity of impregnate and the uniformity of the impregnate in the substrate. It is critical that the volume of impregnate available at the nip be limited to a volume equal to or less than the apparent void volume of the substrate when compressed to a thickness equal to the nip gap.

12 Claims, 1 Drawing Figure

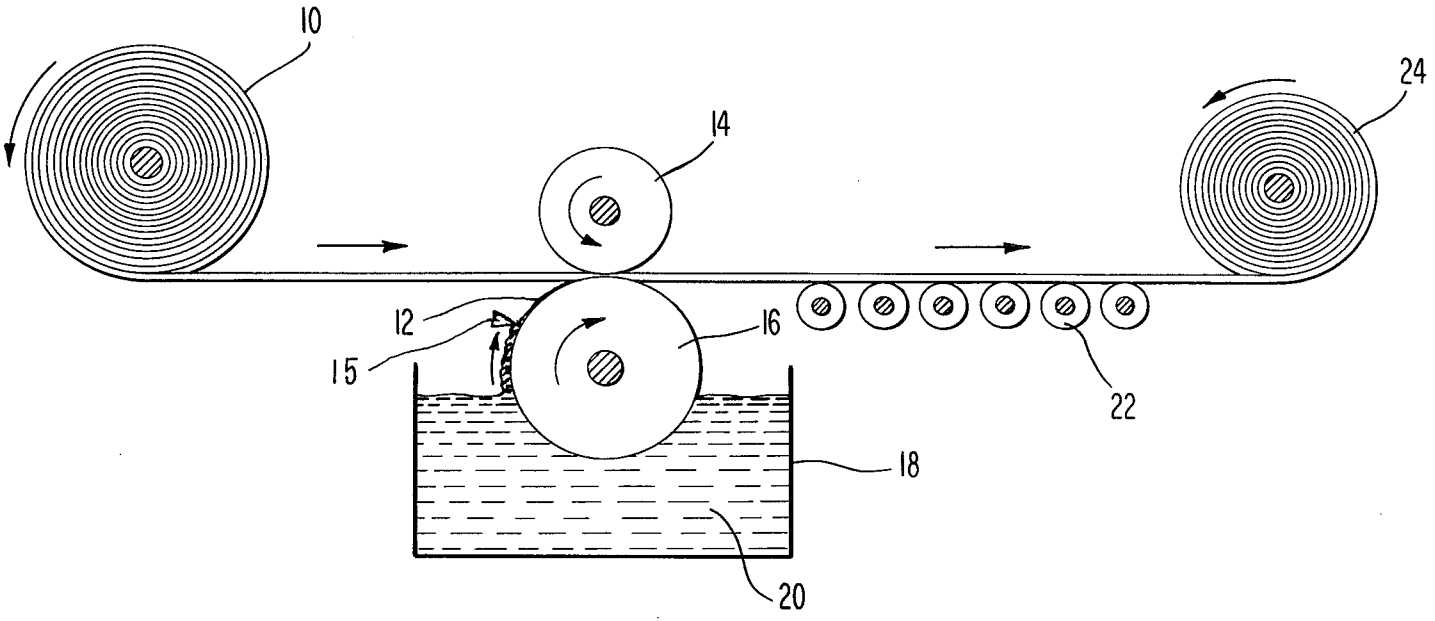
10
12
14
15
16
18
20
22
24

IMPREGNATING FOAM WITH LIQUID FABRIC CONDITIONER

BACKGROUND OF THE INVENTION

1. Field of the Invention

This invention relates to fabric-softening products suitable for use at elevated temperatures encountered in laundry dryers. In particular the invention relates to impregnating liquid fabric softening agents into absorbent substrates.

2. Description of the Prior Art

Surface modification of fabrics, particularly cellulosic fabrics, to soften and impart properties such as antistatic, lubricating, bacteriostatic, mildew-proof and moth-proof properties has been accomplished by treating the fabrics with appropriate chemicals for modifying such properties. It is now common practice to treat various types of household apparel and fabrics with one or more specialized conditioning agents which affect the softness of the fabrics.

For various beneficial reasons, the practice has recently developed of softening and otherwise conditioning household apparel and fabrics during drying after laundering. Fabric conditioning products comprising sheet goods (substrate) coated or impregnated with a fabric-softening chemical and/or other specialized fabric conditioning chemicals have been commingled with damp laundry during the drying of the laundry at the elevated temperatures encountered in a typical household laundry dryer. At the elevated temperature, specialized fabric conditioning chemicals are released from the product and transferred to the commingled fabrics during drying.

Typical absorbent sheet goods employed as a substrate for heat-activated, fabric-softening products include flexible foam, felted, non-woven, and wet-lay fibrous sheets such as paper toweling, scrims, cloth, and air-lay webs containing cellulosic or synthetic fibers of papermaking-length or longer. For example see U.S. Pat. No. 3,442,692 entitled METHOD OF CONDITIONING FABRICS.

Fabric-softening chemicals and other specialized chemicals for conditioning fabrics have been coated onto thin substrates. Preferably, to avoid staining and other problems during drying, the conditioning chemicals have been impregnated into absorbent substrate in combination with controlling the absorbent characteristics of the substrate. For example see U.S. Pat. No. 3,686,025 entitled TEXTILE SOFTENING AGENTS IMPREGNATED INTO ABSORBENT MATERIALS.

Fabric conditioner chemicals have been applied in liquid form (a molten bath or a solution made with a solvent) to the absorbent substrate and then solidified (by cooling or evaporating the solvent).

Impregnating absorbent substrates with liquid fabric conditioning agents was previously accomplished by applying excess liquid to the substrate followed by squeezing off excess liquid with rollers forming a compression nip. A typical disclosure of the technique of applying excess liquid to the absorbent substrate followed by squeezing off the excess with rollers is contained in U.S. Pat. No. 3,686,025 from column 14, line 68 to column 15, line 44.

British Patent No. 1,419,647 discloses another method of impregnating an absorbent substrate with one roller. Substantial compression of the substrate is avoided (see page 5, lines 30 to 35).

Applying a discrete surface coating to a paper type web is disclosed in U.S. Pat. No. 3,895,128. However, impregnating a web is not taught (see column 7, line 47 to column 8, line 23).

SUMMARY OF THE INVENTION

The process of impregnating absorbent substrates with liquid fabric conditioning chemicals by compressing the substrate in a nip while in the presence of the liquid, is improvement by limiting the volume of liquid being supplied to the nip during compression of the substrate to no more than the apparent void volume of the substrate when compressed to the thickness defined by the nip gap. Preferably, the required volume of fluid is supplied to the nip by applying an excess quantity of fluid to the lower roller of the nip and removing the excess from the lower roll with a doctor located before the nip.

BRIEF DESCRIPTION OF THE DRAWING

The FIGURE schematically depicts the manufacture of a heat activatable, fabric conditioning product with limiting the volume of liquid supplied to a nip while compressing the absorbent substrate.

DETAILED DESCRIPTION OF THE INVENTION AND PREFERRED EMBODIMENT

Absorbent substrates suitable for use in the present invention should have a thickness of at least about 0.05 centimeters and substantial "free space" or "void volume". Examples of suitable absorbent substrates are sponges, flexible foams, non-woven fabrics such as multi-ply paper, high bulk paper, felted fabrics and knitted or woven bulky fabrics.

The free space of substrates can be defined in terms of the absorbent capacity determined according to a standard test. A test for determining absorbent capacity of thick paper, foam or cloth substrates is U.S. Federal Specifications UU-T-595b modified as follows:

(1) tap water is used instead of distilled water;

(2) the specimen is immersed for 30 seconds instead of 3 minutes;

(3) draining time is 15 seconds instead of 1 minute; and (4) the specimen is immediately weighted on a balance scale having a pan with turned-up edges.

High bulk, low density paper products (having a basis weight of greater than about 100 pounds per 3,000 sq. ft. and a thickness greater than about 1/16 inch) have an abosrbent capacity value as determined by the above test of greater than about 6.0 and are suitable for use in the present invention.

Absorbent substrates impregnated with a heat-softenable, fabric-conditioner are well known and will be referred to hereinafter as heat-activatable fabric conditioning products and also as "impregnated substrate".

One or more fabric conditioning chemicals may be used and may be mixed with other optional additives such as anti-static agents and perfumes. Usually, the amount of fabric conditioning chemical impregnated into the substrate will be from about 0.023 to about 0.123 grams per cubic centimeter of unimpregnated substrate.

The substrate is usually in the form of a long, wide sheet having a thickness of about 0.05 centimeters or thicker with a thickness of about 0.25 centimeters preferred.

The preferred substrate is flexible foam sheet material having a void volume of greater than about 80% (preferably greater than about 95%) and a thickness of greater than about 0.05 centimeters. A void volume of greater than about 80% correlates approximately with an absorbent capacity value as determined by the above test of greater than about 10.

Void volume is expressed as a percentage of the total volume and is equal to the apparent total volume of the substrate less the volume of the substrate material. For substrates having high void volumes of greater than 80%, such as polyurethane foam, the apparent volume is readily determined by cutting the foam into a convenient shape such as a cube for which the volume is easily calculated. The volume of the polyurethane material comprising the foam can be calculated by weighing the foam cube and calculating the volume based upon the density of the polyurethane. The difference between the volume of the uncompressed cube and the volume of the polyurethane equals the void volume. Alternatively, the volume of the polyurethane material could be determined by displacement in which the volume of a liquid is measured before and after the foam cube is submerged into the liquid and any entrapped air is expelled (squeezed out).

The "apparent void volume of the substrate when compressed to the thickness defined by the nip gap" refers to the uncompressed void volume times the quotient obtained by dividing the minimum nip gap by the uncompressed height of the substrate before entering the nip. In the above definition, nip gap refers to the pre-set nip gap prior to compressing the foam except when a nip is used that does not have pre-set nip gap in which case it refers to the actual nip gap during compressing of the substrate which must be estimated by measuring the nip gap during operation.

Preferred foam sheet material is flexible, polyether-based, polyurethane foam having a thickness of about 0.25 centimeters and a pore size in the range of from about 10 pores per inch to about 100 pores per inch. High porosity foam is particularly preferred. While woven, nonwoven or knitted cloth fabrics are suitable, they are not preferred in practicing the present invention.

Heat-activatable fabric conditioning products of the present invention are produced by impregnating a suitable substrate with a liquid fabric conditioning composition followed by solidifying the composition in the substrate. Impregnation is accomplished by contacting the substrate with the liquid fabric conditioning composition, squeezing the substrate in the presence of the liquid and allowing the substrate to expand while still in the presence of the liquid. Preferably the fabric conditioner is liquidified by being held at an elevated temperature above the melting point. Solvents can be used to lower the melting and viscosity of the fabric conditioner chemicals.

With the hot-melt technique, the impregnated substrate is cooled to solidify the fabric conditioning composition after impregnation. The present invention is particularly suitable for impregnating with liquids having a high viscosity.

Fabric conditioning chemicals and mixtures thereof suitable for use in heat-activatable fabric conditioning products are well known and disclosed in U.S. Pat. No. 3,442,692 issued to C. J. Gaiser on May 6, 1969, entitled METHOD OF CONDITIONING FABRICS at column 3, line 7 to column 4, line 24 whih disclosure is incorporated herein by reference with respect to its teachings of suitable fabric conditioning chemical compositions. U.S. Pat. No. 3,632,396 issued on Jan. 4, 1972 entitled DRYER-ADDED FABRIC-SOFTENING COMPOSITION discloses suitable heat-activated fabric sotening compositions at column 7, line 70 to column 12, line 73 which disclosure is also incorporated herein by reference with respect to its teachings of heat-activatable fabric softening and conditioning chemicals. Suitable compositions are also disclosed in U.S. Pat. Nos. 3,686,025; 3,870,145 and 3,895,128. Usually, from about 2 to about 10 ounces of active ingredients (fabric conditioner chemical) are impregnated per square yard of substrate with about 4 ozs. per square yard being preferred.

The process of the present invention for producing a heat-activated fabric conditioning product can be best understood with reference to the drawing. Suitable absorbent substrate, 10, passes through the nip of mating rollers 14 and 16 where it is compressed in the presence of molten fabric conditioning composition, 12, which causes impregnation of the liquid (molten) fabric conditioning composition into the substrate 10. The fabric conditioning composition 12, (composed of one or more heat-activatable fabric conditioner chemicals along with any other additives if desired, such as perfumes or solvents) is supplied to the nip by lower roller 16 which is partially immersed in a molten bath 20, contained in heated tank 18. Doctor blade, 15 controls the volume of liquid supplied to the nip by lower roller 16. The impregnated substrate expands as it leaves the nip formed by rollers 14 and 16 which completes the impregnating process. The impregnated product passes over rollers 22 where solidification of the impregnant occurs as the impregnated substrate cools to ambient temperatures. Preferably, rollers 14 and 16 are both driven to rotate at the same peripheral speed.

The improvement provided by the present invention in the above process concerns limiting the volume of liquid 12, supplied to the nip. The volume of liquid in contact with the substrate entering the nip must be equal to or less than the apparent void volume of the substrate at a thickness equal to the nip gap. This is readily accomplished by restricting the volume of fluid supplied to the nip to prevent build up of excess liquid in contact with the substrate entering the nip.

In practice, it is preferred to set the doctor blade to a predetermined gap to restrict the volume of liquid being supplied to the nip and then adjust the nip gap during operation of the process usually by lowering the upper roller 14 to the point of incipient frothing. Incipient frothing indicates that the volume of liquid supplied to the nip approximately equals the apparent void volume.

In the FIGURE, control of the volume of liquid applied to the nip is accomplished with a doctor blade that restricts the quantity of fluid retained on the surface of lower roller 16. The apparatus shown in the FIGURE is an illustration of one means for restricting the volume of liquid entering the nip. Many alternative means for restricting the liquid volume entering the nip are suitable for practicing the present invention in addition to the means depicted in the FIGURE. A metering pump could be used to supply a spray head with the precise volume of liquid to be sprayed at the nip area as an alternative means for controlling the volume of fluid to the quantity required for practicing the present invention.

When the volume of fluid exceeds the maximum apparent volume of the substrate when compressed to the thickness defined by the nip, then substantial operating problems occur such as frothing of liquid at the nip, irregular and nonuniform levels of liquid impregnated into the substrate and most surprisingly a minimum develops for the quantity of liquid that can be impregnated into the substrate. Impregnant quantities below the minimum cannot be obtained.

The present invention and the problems associated with exceeding the limitation discovered for the amount of fluid supplied to the nip with the substrate are demonstrated by the following examples. All proportions are by weight unless indicated otherwise.

EXAMPLE I

Several samples of a fine cell (approximately 80 pores per inch), flexible, polyether based, polyurethane foam having a density of about 1.4 pounds per cubic foot and a thickness of about 0.085 inches were impregnated with various quantities of a molten fabric conditioning composition comprising 84.8% by weight Varisoft® 137 and 15.2% by weight Varonic® 485. The process shown in the FIGURE was used for impregnating the foam samples with the molten fabric conditioning agents. The amount of liquid fed to the nip simultaneously with the absorbent substrate was varied by adjusting the space between the doctor blade 15 and lower roller 16. The nip gap was 0.020 inches and the uncompressed void volume of the foam was 98% of the total volume of the foam. With the process as depicted in the FIGURE, the ratio of the volume of fluid fed to the nip to the apparent void volume of the foam when compressed to the thickness of the nip gap is simply the ratio:

$$\frac{\text{(space between the doctor blade and the lower roller) (100)}}{\text{(nip gap) (uncompressed void volume \%)}}$$

In Example 1, the space between the doctor blade and the lower roller was 0.010 inches, the nip gap was 0.020 inches and the foam had a void volume (percentage) of 98% of the total volume of the foam. Accordingly, the ratio of fluid volume to compressed void volume equals (0.010 inches) (100)/(0.020 inches) (98) which equals 0.51. It is critcal that this ratio be equal to or less than 1 which corresponds with the volume of impregnate available at the nip being limited to a volume equal to (ratio of 1.0) or less than the void volume of the substrate at the apparent thickness of the substrate when compressed to a thickness equal to the nip gap. Samples 1 through 4 were made with the quantity of liquid in contact with the web entering the nip being less than the apparent void volume of the foam when compressed to the thickness of the nip gap (ratio of less than 1.0). Samples A through D were made with the quantity of liquid in contact with the substrate during compression being greater than the apparent void volume of the foam when compressed to the thickness of the nip gap (ratio greater than 1.0). Samples 1 through 4 were characterized by having a very uniform level of liquid impregnated throughout the foam sheet exiting the nip. Samples A through D had irregular quantities of impregnate in the foam leaving the nip (streaks), and frothing of the liquid in front of the nip occurred along with a buildup of liquid at the entrance to the nip.

The following Table gives the data for Samples 1 through 4 and A through D in terms of the quantity of liquid supplied to the nip reported as fluid film thickness (inches×1000), nip gap (inches×1000), void volume of the foam (percentage) and the ratio of (fluid film thickness times 100) to (nip gap times void volume).

As can be seen from the data given in the Table, irregular unacceptable product is obtained when the volume of liquid supplied to the nip with the absorbent substrate exceeds the apparent void volume of the substrate at the thickness equal to the nip gap. In addition the quantity of liquid that can be impregnated into the absorbent substrate dramatically changes when excess fluid is supplied to the nip.

Varisoft® 137 is a dialkyl dimethyl quarternary fabric softening chemical obtainable from Ashland Chemical Company and is defined chemically as dihydrogenated-tallow dimethyl ammonium methyl sulfate having a melting point of 138° C. and a molecular weight of about 645.

Varonic® 485 is a nonionic fabric conditioning chemical obtainable from Ashland Chemical Company and is believed to be a nonionic modified glyceryl monosterate having an HLB value of about 8.4.

The blend of Varisoft 137 and Varonic 485 employed in Example I was diluted with about 6% isopropanol and had a melting point of about 50° C.

The best mode presently contemplated for practicing the present invention is shown in the FIGURE with the means for limiting the volume of liquid supplied to the nip being accomplished by a set doctor blade, with an adjustable nip gap and with the fabric softner liquefied by being held at an elevated temperature. Preferably, the volume of fluid supplied to the nip is about equal to the apparent void volume of the substrate.

TABLE

| Sample # | Fluid Film Thickness (Doctor Gap) | Nip Gap | % Void Volume | Ratio | Comments |
|---|---|---|---|---|---|
| 1 | 10 | 20 | 98 | .51 | |
| 2 | 13 | 20 | 98 | .663 | |
| 3 | 16 | 20 | 98 | .816 | |
| 4 | 19 | 20 | 98 | .97 | |
| A | 20 | 20 | 98 | 1.02) | Frothing, |
| B | 22 | 20 | 98 | 1.12) | indicated by |
| C | 25 | 20 | 98 | 1.27) | visable streaking |
| D | 28 | 20 | 98 | 1.42) | in impregnated material, i.e., uneven coating within a 3 7/16" sample* |

What is claimed is:

1. In a method of manufacturing a heat-activatable fabric conditioning product by impregnating an absorbent substrate having a thickness of at least 0.05 centimeters with a solidifiable fabric conditioner, wherein said impregnating is carried out by the steps comprising:

(a) providing said fabric conditioner in liquid form;

(b) contacting the substrate with the liquid conditioner;

(c) passing the contacted substrate between opposed solid surfaces so as to simultaneously compress the substrate and drive liquid conditioner from outside the substrate into the substrate;

(d) expanding the substrate; and (e) solidifying the fabric conditioner;

the improvement which comprises limiting the amount of liquid conditioner that contacts the substrate as it enters step (c) to no more than the apparent void volume of the substrate when compressed.

2. The method of claim 1 wherein the absorbent substrate is a flexible polyurethane foam.

3. The method of claim 1 wherein the absorbent substrate is a flexible, polyether-based polyurethane foam having a cellular size in the range of from 10 pores per inch to 100 pores per inch and having a void volume of at least about 80%.

4. The method of claim 1 wherein the amount of fabric conditioning chemical impregnated into the absorbent substrate is from about 2 ounces per square yard of absorbent substrate to about 10 ounces per square yard.

5. The method of claim 1 wherein the volume of liquid is limited to less than 80% of the apparent void volume of the substrate when compressed.

6. The method of claim 1 wherein the thickness of the substrate is reduced during compression to less than 80% of its uncompressed thickness.

7. In the method of manufacturing a heat-activatable fabric conditioning product comprising impregnating an unsaturated, absorbent substrate having a thickness of at least 0.05 centimeters with a solidifiable liquid fabric conditioning chemical by compressing and then expanding the unsaturated substrate in the presence of the liquid, followed by solidifying the fabric conditioning chemical in the substrate; the improvement which comprises:

accomplishing the compressing and then expanding by passing the substrate through a nip formed by two rollers, rotating the lower roll of the nip while the lower portion of the roller is partially immersed in a reservoir of the liquid, limiting the volume of liquid with a doctor means positioned in close proximity to the lower roller, radially disposed in the direction of rotation of the lower roller after the lower portion of the roller that is immersed in the reservoir, and preselecting a gap between the doctor means and the lower roller for limiting the volume of liquid available to the unsaturated substrate before compressing and expanding of the substrate to no more than the apparent void volume of the substrate while compressed.

8. The method of claim 7 wherein the absorbent substrate is a flexible polyurethane foam.

9. The method of claim 7 wherein the absorbent substrate is a flexible, polyether-based polyurethane foam having a cellular size in the range of from 10 pores per inch to 100 pores per inch and having a void volume of at least about 90%.

10. The method of claim 7 wherein the amount of fabric conditioning chemical impregnated into the absorbent substrate is from about 2 ounces per square yard of absorbent substrate to about 10 ounces per square yard.

11. The method of claim 7 wherein the volume of liquid is limited to less than 80% of the apparent void volume of the substrate when compressed to a thickness equal to the nip gap.

12. The method of claim 7 wherein the thickness of the substrate is reduced during compression to less than 80% of its uncompressed thickness.

* * * * *